United States Patent [19]

Vigreux

[11] Patent Number: 4,828,301

[45] Date of Patent: May 9, 1989

[54] LOCKING FITTING, IN PARTICULAR FOR SLIDING CASEMENT

[75] Inventor: Daniel Vigreux, Biberkirch, France

[73] Assignee: Ferco International Usine de Ferrures de Batiment, Sarrebourg, France

[21] Appl. No.: 42,828

[22] Filed: Apr. 27, 1987

[30] Foreign Application Priority Data

May 2, 1986 [FR] France ..... 86 06495

[51] Int. Cl.[4] ..... E05C 1/08

[52] U.S. Cl. ..... 292/355

[58] Field of Search ..... 292/333, 335, 332, 334, 292/336, DIG. 46

[56] References Cited

U.S. PATENT DOCUMENTS 4,049,304 9/1977 Imhoff ..... 292/333

4,478,444 10/1984 Kurz et al. ..... 292/333

FOREIGN PATENT DOCUMENTS 011744 9/1984 European Pat. Off. .

*Primary Examiner*—Richard E. Moore

*Attorney, Agent, or Firm*—Sandler & Greenblum

[57] ABSTRACT

The invention is directed to a locking fitting, in particular for sliding casements of windows, doors or similar ports, that includes an assembly in a housing composed of a slide connected to a bolt for the purpose of locking the bolt in position and a locking device fitted with a pawl featuring at least one tooth and actuated by a grip integral with the slide and for controlling the locking device featuring a no-load run of the slide prior to moving the bolt.

This locking fitting is characterized in that it comprises a blocking device with resilient pull-back that locks the bolt in its open position which is integral with the slide in shifting.

12 Claims, 3 Drawing Sheets

LOCKING FITTING, IN PARTICULAR FOR SLIDING CASEMENT

BACKGROUND OF THE INVENTION

1. Field of the Invention

The invention concerns a locking fitting, in particular for sliding casements of windows, doors or similar ports, that comprises, in a housing, a slide connected to a bolt for the purpose of locking the latter bolt in its position and, positioned one underneath the other in the slide's direction of displacement, a locking device fitted with a pawl featuring at least one tooth and actuated by a grip integral with the slide and by a locking device means of control featuring a no-load run of the slide prior to moving the bolt. The locking fitting of the present invention is useful, particularly, in the field of hardware for the building industry.

2. Discussion of the Background of the Material Information

We already know a locking fitting for sliding casements that comprises a slide lodged in a housing and connected to a catch bolt. This slide allows the conferring on the catch bolt a vertical displacement for the purpose of moving it into a position that corresponds to the unlocking or the locking of the sliding casement. This locking fitting also comprises a locking device, the function of which consists in blocking the catch bolt in its locking position.

More specifically, this locking device is fitted with a pawl featuring a tooth that co-operates, when the bolt is in its locking position, with a slot made in one of the walls of the housing. This pawl is actuated via a grip integral with the slide and a means of control also fitted to the latter. The means of control allows for a no-load run of the slide prior to moving the catch bolt, with the projecting or withdrawing of the tooth taking place during this no-load run of the slide, depending on conditions.

So as to decrease the side of this locking fitting significantly and so as to make its installation in the low width jamb of the casement easier, the locking device and the means of control of the latter are positioned one underneath the other in the direction of displacement of the slide.

However, this known type of locking fitting has a certain number of drawbacks, in particular where its performance in operation is concerned.

in this regard, when the casement is in open position and when the grip integral with the slide moving the bolt into the locking position is actuated improperly, the bolt may find itself facing the keeper. Under these conditions, while closing the casement, the bolt catch may collide with the keeper. This collision causes deterioration of the bolt and/or of the keeper. This risk of deterioration is increased by the co-operation of the tooth of the pawl with the slot made in one of the parallel walls of the housing.

SUMMARY OF THE INVENTION

The purpose of the invention is to design a device that eliminates any risk of faulty manipulation that may cause the deterioration of the locking fitting mechanism of a sliding casement of windows, doors or similar.

For this purpose, the invention concerns a locking fitting, in particular for sliding casements of windows, doors or similar ports that comprised, in a housing, a slide connected to a bolt for the purpose of locking the latter in position and, positioned one underneath the other in the direction of displacement of the slide, a locking device fitted with a pawl featuring at least one tooth and actuated by a grip integral with the slide and by a locking device means of control featuring a no-load run of the slide prior to moving the bolt. The lock fitting is characterized in that it comprises a blocking device with resilient pull-back that locks the bolt in its open position which integral with the slide in shifting.

The benefits provided by this invention consist essentially in that it is impossible to manipulate the slide after the casement is open and only closing the casement again will release the slide, thus allowing for returning the bolt from its opening position to its locking position.

BRIEF DESCRIPTION OF THE DRAWING

The invention will be understood perfectly by referring to the following description made as an example without any restrictive intention and to the drawings appended hereto where.

Figure 1:
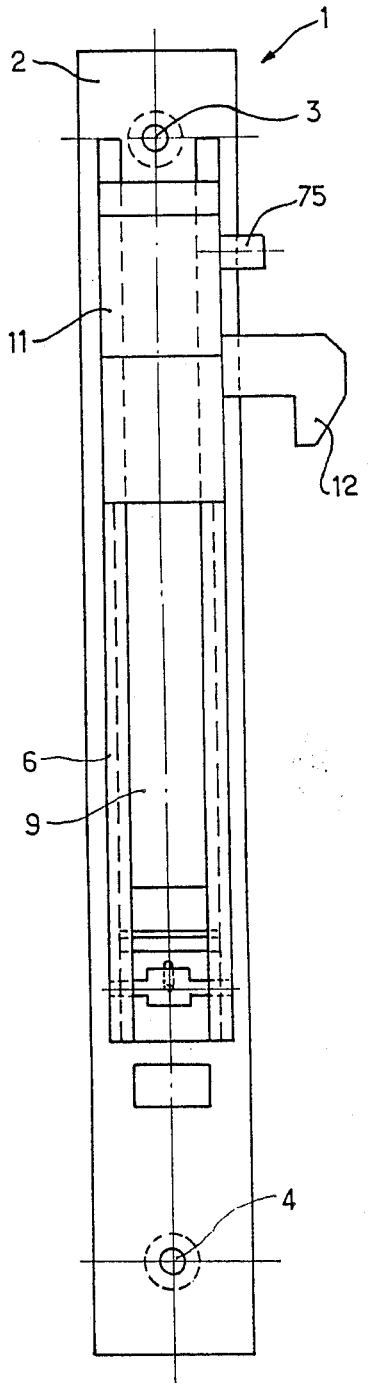
FIG. 1 is a view in elevation of the locking fitting according to the invention.
Figure 2:
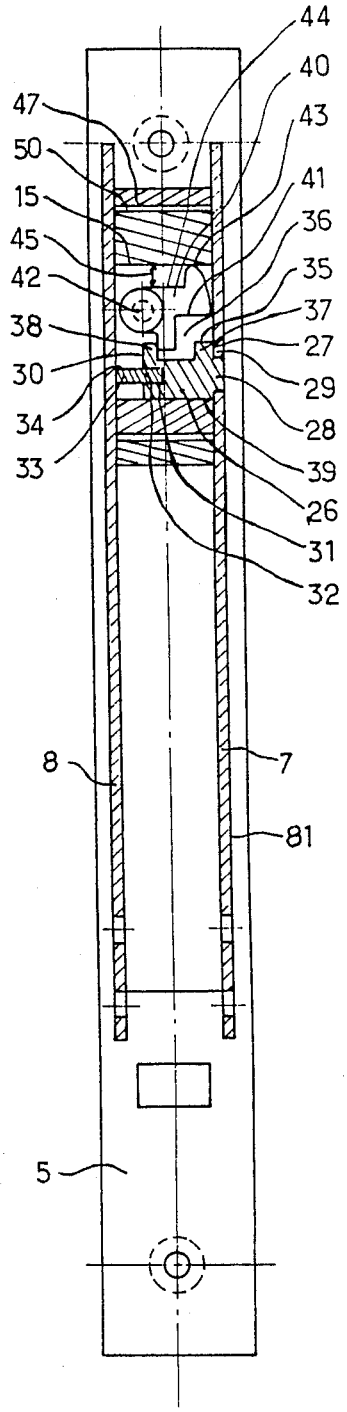
FIG. 2 is a view in elevation and section according to II—II of FIG. 3 of the locking device lodged in the housing.

We refer to the various figures.

DETAILED DESCRIPTION

The locking fitting 1 comprises, according to the invention, a mounting plate 2 provided with holes 3,4 as passages for fixing elements that allow for making the locking fitting 1 integral with the casement of windows, doors or similar ports.

The back face 5 of the mounting plate 2 is provided with a housing 6. The latter which consists essentially of two parallel walls 7,8 serving as a guide for a slide 9. This slide 9 moves the length of the back face 5 of the mounting plate 2 and comprises a grip 10. Furthermore, the slide 9 is connected to a catch bolt 12 via a bolt holder 11. The back face 13 of the slide 9 has a recess 14 limited, in the direction of the displacement of the slide 9, by its top edge 15 and by its bottom edge 16.

In this recess 14 is lodged the front face 17 of the bolt holder 11. The bolt holder is made integral of the slide 9 on one hand, by means of a groove 18 that consists of a U-shaped trough 19 open towards the bottom which engages a vertical wing 20 that extends beyond the top face 21 of the slide 9. On the other hand, the bolt holder 11 comprises in its bottom section 22 a hook-shaped element that co-operates with a flange 24, in parallel with the bottom of the recess 14 and as compared to the bottom edge 16 of the slide 9.

The bolt holder 11 has on its front face 17 a locking device 25. This locking device has a pawl 26 that slides cross-wise as compared to the direction of displacement of the slide 9. This pawl 26 features on one of its lateral faces 27 a tooth 28 that co-operates with at least one slot 29 made in one of the parallel walls 7 of the housing 6.

The other lateral face 30 of the pawl 26 is provided with hole 31 into which one of the outer ends 32 of a resilient element 33 is engaged so that the other outer end 34 rests against the other parallel wall 8 of the housing 6. This resilient element 33 confers on the pawl 26 a resilient back-pull so that when the tooth 28 of the pawl 26 is facing the slot 29, the tooth 28 automatically penetrates slot under the thrust of the resilient element 33 under pressure.

The pawl 26 features on its top face 35 a recess 36 that allows for obtaining two parallel edges 37,38 arranged in perpendicular to the run of the pawl 26. Into this recess 36 engages a control finger 39 of a means of control 40. This control finger 39 is salient as compared to the bottom edge 41 of the means of control 40. The latter is able to pivot around an axis of rotation 42 that is perpendicular to the direction of displacement of the slide 9.

The means of control 40 has a second control finger 43 that is salient as compared to the top edge 44 of the means of control 40. The height 45 of the second control finger 43 corresponds to a no-load run 46 of the slide 9 prior to moving the bolt holder 11. In the locking position of the locking fitting 1, the top edge 44 is removed from the top edge 15 of the recess 14 to the extent of the no-load run 46.

This no-load run 46 corresponds to the difference of the clearances that exist, on one hand, between the bottom 47 of the groove 18 and a top stop plane 48 that consists of a shoulder 49 made on the front face 17 of the bolt holder 11 and, on the other hand, between the top edge 50 of the vertical wing 20 and the top edge 15 of the recess 14 of the slide 9.

The locking fitting 1 functions as follows:

With the slide 9 in the locking position, the slide may be pushed downwards by actuating the grip 10. The top edge 15 of the recess 14 pushes the control finger 43 downwards so that the means of control 40 pivots around its axis of rotation 42. The control finger 39 thrusts back the edge 38 of the pawl 26 by compressing the resilient element 33. In this manner, the tooth 28 disengages the slot 29 and the bolt 12 is unlocked. These operations take place during the no-load run 46 of the slide 9.

After the no-load run 46 is over, during which the full withdrawal of the control finger 43 has taken place, the top edge 15 of the recess 14 of the slide 9 makes contact with the top stop plane 48 of the bolt holder 11 and thrusts the latter downwards, which causes the bolt 12 to move into the opening position.

Inversely, by thrusting the grip 10 upwards, the top edge 50 of the vertical wing 20 actuates the bolt holder 11 only by making contact with the bottom 47 of the groove 18 i.e. after a no-load run equal to the no-load run 46. During this no-load run, the top edge 15 of the recess 14 moves away from the top stop plane 48. As the control finger 43 is no longer held by the top edge 15 and under the effect of the resilient element 33, the edge 38 of the pawl 26 thrusts back the control finger 39 so that the means of control 40 pivots, in the opposite direction as above, around its axis of rotation 42 until the control finger 43 emerges once again from the top stop plane 48. At the same time, the resilient element 33 thrusts back the pawl 26 and the tooth 28 penetrates the slot 29. In this manner, the bolt holder 11 and, consequently, the catch bolt 12 are locked.

According to this invention, the locking fitting 1 comprises a blocking device 51. This blocking device 51 has a guide 52 positioned above the fixing and set screw 53 of the catch bolt 12. This guide 52 is subject to perpendicular displacement in the direction of displacement of the slide 9. For this purpose, a lodging 55 that passes through bolt holder 11 is provided in the outer face 54 of the bolt holder 11 integral with the slide 9. This lodging 55 has in its bottom face 56 a recess 57 that defines two shoulders 58,59 serving as guides for a bottom boss 60 of the guide 52. Furthermore, we make in one of the vertical walls 61 a recess 62 that defines two other shoulders 63,64 that co-operate with a lateral boss 65 of the guide 52. In this manner, the latter is guided both vertically and laterally. On the opposite side of this lateral boss 65, the guide 52 is provided with a second lateral boss 66 of which the height 67 is larger than the thickness 68 of the angles 69,70 of the walls 7,8 of the housing 6. Furthermore, the width 71 of the guide 52 is smaller than the distance 72 between the inner edges 73,74 of the aforesaid angles 69,70 so that the aforesaid guide 52 is able to slide vertically.

The guide 52 serves as a support for a feeler 75. and a bore 77 end-to-end with a threaded hole 78 is provided in the outer face 76 of the guide 52. Into this threaded hole 78 is screwed a threaded rod 79 that is the body of the feeler 75. This threaded rod 79 follows a head 80 that is salient not only as compared to the face 80 of the wall 7 of the housing 6 but also as compared to the edge of the casement, with the latter displaying for this purpose an oblong opening for the passage of the aforesaid head. The feeler 75 may be a screw, the head of which would be suitable for taking the impact when the casement is being closed, without suffering any deformation.

A slot 82 is provided in the threaded rod 72 that makes up the body of the feeler 75. Into slot 82 is lodged the bottom end 83 of a resilient element 84, the body 85 of which is housed in a lodging 86. This lodging 86 is, to advantage, a hole made from the top face 87 of the bolt holder 11. The lodging 86 is connected to the lodging 55 by a slit 88 that allows for the passage of the resilient element 84.

According to the invention, the blocking device 51 is positioned in a plane 89 parallel to the plane 90 that passes through the locking device 25 and its means of control 40.

Furthermore, a disengagement 91 is provided in wall 7 so as to obtain a stop plane 92. The width 93 of this stop plane 92 is equal, at least, to the height 67 of the second lateral boss 66 of the guide 52. The design of the blocking device 51 is such that it is possible to use the catch bolt 12 either to the right or to the left.

Another embodiment provides for operating the blocking device 51 through fixtures on the back face of the guide 52 that, during the opening phase, would be such that it becomes imbricated in the walls of the bolt holder 11 thereby and blocking it against the walls 7,8 of the housing 6.

Figure 3:
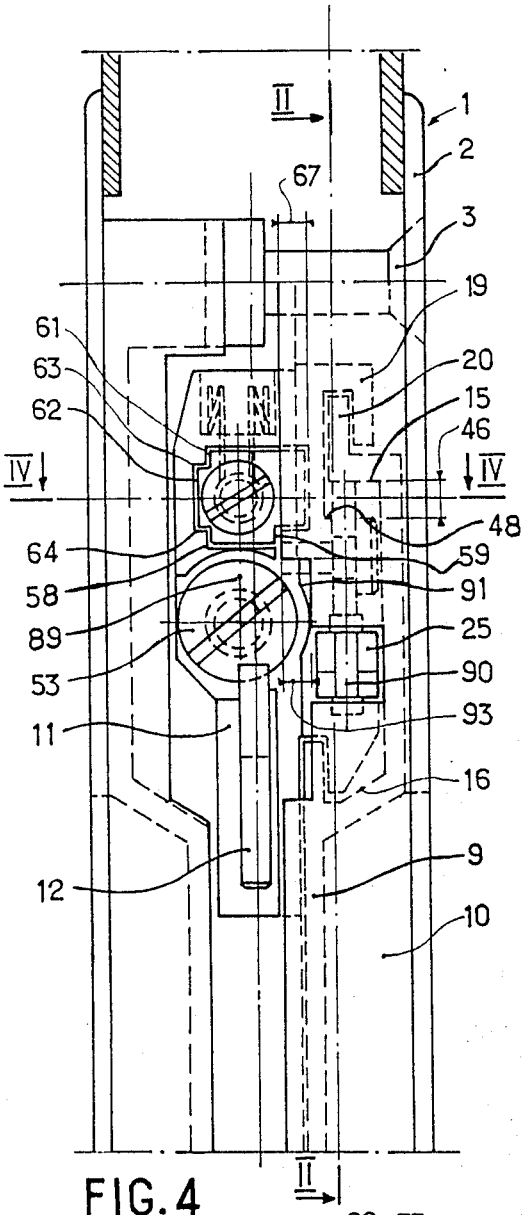
FIG. 3 is a view in elevation of the locking fitting in the locking position of the casement comprising, according to the invention, a blocking device.
Figure 5:
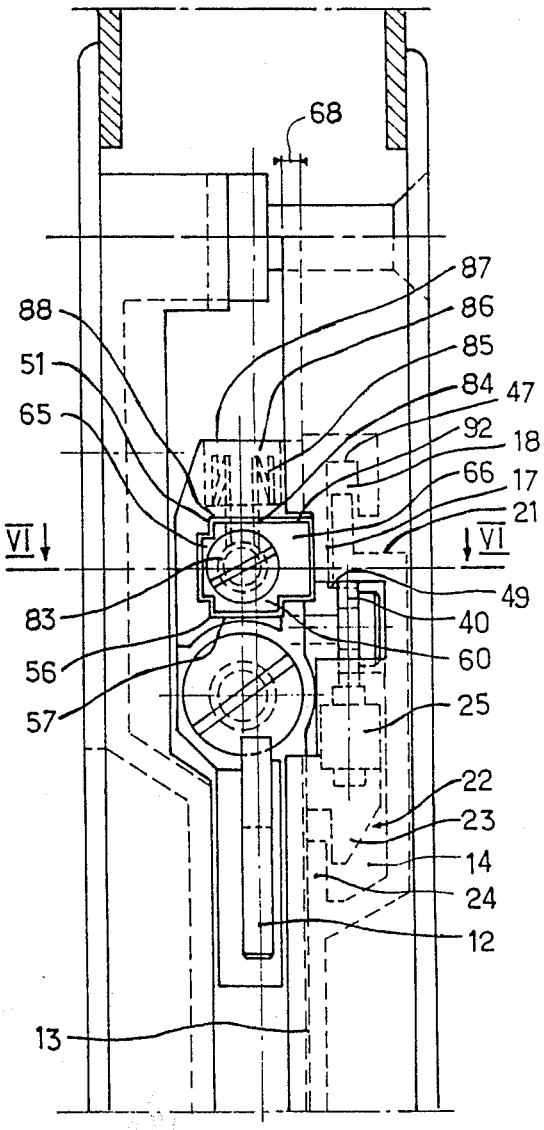
FIG. 5 is a view in elevation of the locking fitting in the opening position of the casement.
Figure 4:
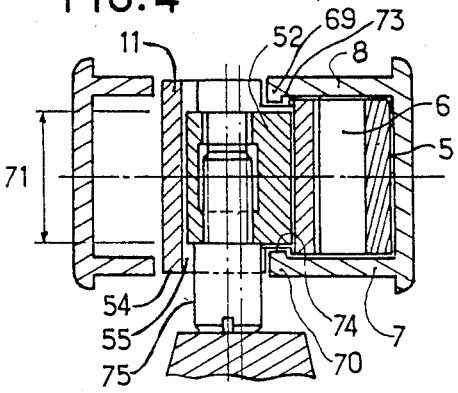
FIG. 4 is a plan view and section taken along the section line IV—IV of FIG. 3.
Figure 6:
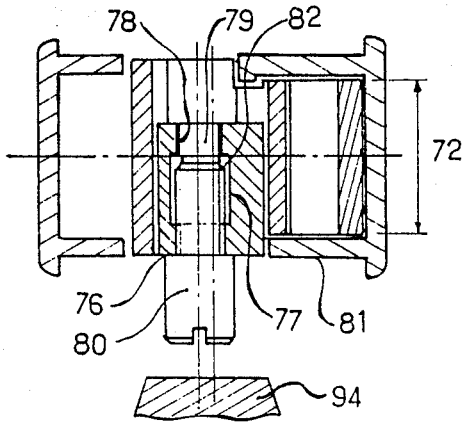
FIG. 6 is a plan view and section taken along the section line VI—VI of the FIG. 5.
Figure 7:
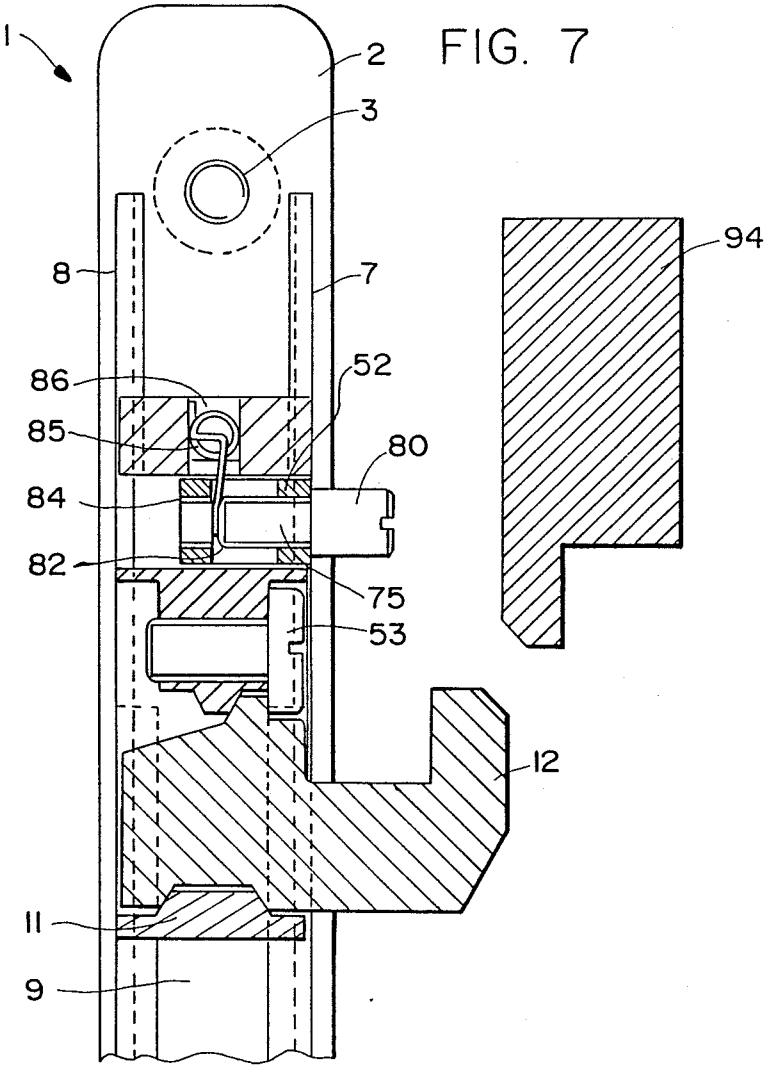
Figure 8:
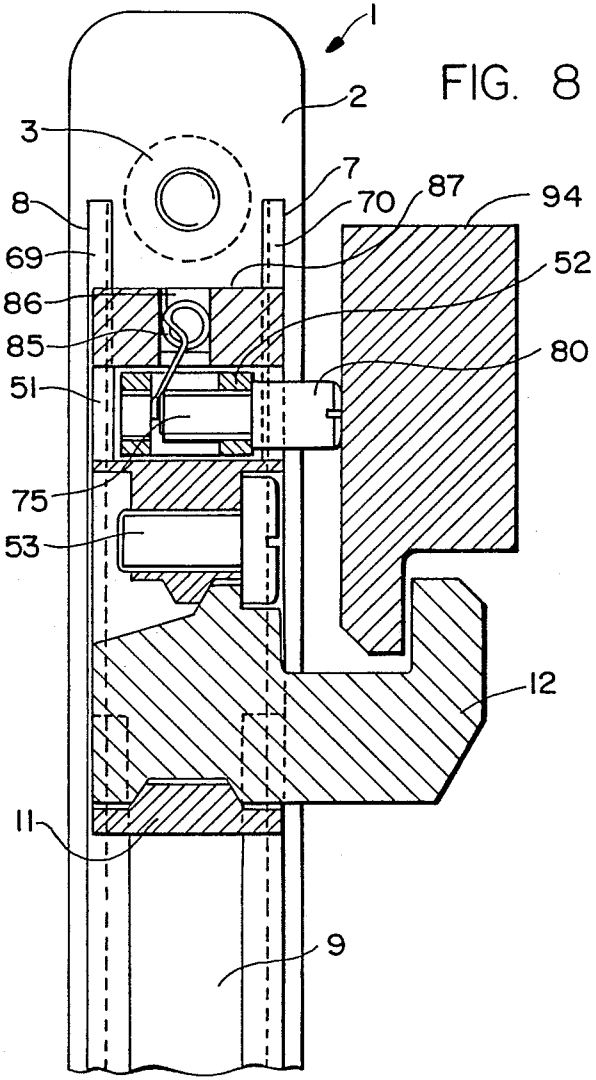

The blocking device 52 functions as follows when the fitting 1 is in a locked position: By actuating the grip 10 the locking device 25 is unlocked via of its means of control 40 and the slide 9 moves while causing the release of the co-operation between the catch bolt 12 and the keeper 94. During this displacement, the guide 52 slides the length of the inner edge 74 of the angle 70 of the wall 7 of the housing 6. When the boss 66 of the guide 52 has moved beyond the stop plane of the disengagement 91 i.e. when the fitting is in the casement opening position, the resilient element 84 thrusts through its bottom end 83 the unit formed by the guide 52 and the feeler 75 outwards so that the outer face 76 of the guide 52 is level with the face 81 of the wall 7 of the housing 6. The co-operation of the boss 66 in position with the stop plane 92 does not permit the slide 9 (cfr. FIGS. 3 and 4) to thrust upwardly.

By closing the casement, the head 80 of the feeler 75 is made to rest against the keeper 94. The co-operation between the head 80 and the keeper 94 causes the guide 52 to move to the rear so that the latter comes to rest between the inner edges 73,74 of the angles 69,70 of the walls 7,8 of the housing 6. In this manner the co-operation between the boss 66 of the guide 52 and the stop plane 92 of the disengagement 91 of the wall 7 is released and we can bring back the slide 9 to its locking position. In parallel, we put the resilient element 84 under pressure.

I claim:

1. A locking fitting comprising (i) a slide connected to a bolt for locking the bolt in position and a locking device positioned under said slide provided with a pawl including at least one tooth actuated by a grip integral with the slide and by a means for controlling the locking device including a no-load run of the slide prior to moving the bolt and (ii) a blocking device integral with the slide having a resilient means for blocking the bolt in an open position.

2. The locking fitting according to claim 1, wherein the blocking device comprises a guide operably associated with a stop in at least one wall of a housing provided with a means for disengagement whereby said blocking device is subject to a vertical displacement in the direction of displacement of the slide.

3. The locking fitting according to one of claims 1 or 2, wherein the guide is adapted to slide in a lodging in an outer face of a bolt holder integral with said slide and comprises two lateral bosses and one bottom boss co-operating with shoulders of recesses in said lodging.

4. The locking fitting according to claim 3 wherein at least one of said lateral bosses has a height greater than a thickness of an angle formed by parallel walls of the housing.

5. The locking fitting according to claim 3, wherein said lateral boss has a height slightly smaller than a width of the stop plane.

6. The locking fitting according to one of claims 1 or 2, wherein said blocking device is provided with a feeler that co-operates with a keeper, said feeler comprising a head and a body having a threaded rod engaged in a bore in an outer face of the guide wherein an end of the threaded rod is screwed into a threaded hole of the guide and abuts on the bore.

7. The locking fitting according to claim 6, wherein the threaded rod of the feeler displays a slot in which is lodged a bottom end of a resilient element maintained under pressure when the bolt is in an open position whereby said resilient element ensures the resilient pull-back of the blocking device.

8. The locking fitting according to claim 7, wherein the resilient element and the blocking device are positioned one underneath the other in the direction of displacement of the slide.

9. The locking fitting according to claims 1 or 2, wherein the guide has a width smaller than a distance separating inner edges of angles formed by parallel walls of the housing.

10. The locking fitting according to claims 1 or 2, wherein said outer face of the guide is level with a face of a wall of the housing.

11. The locking fitting according to claim 1, wherein the blocking device is reversible about the fitting either to the left or to the right.

12. The locking fitting according to claim 1, wherein the blocking device has a guide having a back face provided with a fixture that imbricates in walls of the bolt holder, thereby blocking said bolt holder against the walls of the housing.

* * * * *